US005795248A

United States Patent [19]

Giglio

[11] Patent Number: 5,795,248

[45] Date of Patent: Aug. 18, 1998

[54] GOLF ACCESSORY CADDY

[76] Inventor: James A. Giglio, 16828 Ellis Ct., South Holland, Ill. 60473

[21] Appl. No.: 744,619

[22] Filed: Nov. 6, 1996

[51] Int. Cl.[6] ..... A63B 57/00

[52] U.S. Cl. ..... 473/406; 224/918

[58] Field of Search ..... 473/406, 408, 473/386, 284, 285, 132; 224/918, 183, 901, 269

[56] References Cited

U.S. PATENT DOCUMENTS

| | | | |
|---|---|---|---|
| 3,136,547 | 6/1964 | Schaper | 473/406 |
| 3,233,802 | 2/1966 | Ludwick | 224/183 |
| 3,298,579 | 1/1967 | Smith | 224/918 |
| 3,415,518 | 12/1968 | Root | 473/406 |
| 4,151,937 | 5/1979 | Jarosh et al. | 473/406 |
| 4,386,774 | 6/1983 | Buckman | 473/406 |
| 4,449,310 | 5/1984 | Kline | 40/11 R |
| 4,699,303 | 10/1987 | Kline | 224/918 |
| 4,830,248 | 5/1989 | Pommenville | 224/269 |
| 5,143,371 | 9/1992 | Strahan . | |
| 5,305,999 | 4/1994 | Tate | 473/406 |
| 5,517,696 | 5/1996 | Krugler | 224/918 |

*Primary Examiner*—Steven B. Wong
*Attorney, Agent, or Firm*—Joseph N. Breaux

[57] ABSTRACT

A golf accessory caddy comprising a body member having a substantially cylindrical shaped ball marker storage cavity formed therein having an access opening defined by a first surface thereof; a flat, semi-circular shaped ball marker retaining magnet positioned within the ball marker storage cavity; a clip member extending from the body member, the clip member defining an insertion slot between the clip member and the body member; and a glove attachment surface covering at least a portion of the first surface having a plurality of members attachable to one of the hook and pile fastener surfaces of an existing golf glove. In one embodiment, a ball marker is provided that is sized to fit within the ball marker storage cavity and that includes a sufficient quantity of magnetically attractable material to allow the ball marker to be held within the ball marker storage cavity by contact with the ball marker retaining magnet. The ball marker is preferably disk shaped and sized such that at least a portion of the ball marker extends over the ball marker retaining magnet when the ball marker completely covers the ball marker retaining magnet.

1 Claim, 2 Drawing Sheets

GOLF ACCESSORY CADDY

TECHNICAL FIELD

The present invention relates to holding and carrying devices and more particularly to a caddy device for holding and carrying golf accessories that can be clipped to the clothing of a golfer.

BACKGROUND OF THE INVENTION

Golfer's often use a number of golf accessories such as golf tees, gloves and ball markers. Carrying these items in a pocket before, after, and during a round of golf can be uncomfortable and lead to the loss of the items. It would be a benefit, therefore, to have a caddy for carrying these accessories that could be clipped to the clothing of a golfer that allowed the accessories to be carried in a readily available, out of the way location for easy retrieval when needed.

SUMMARY OF THE INVENTION

It is thus an object of the invention to provide a golf accessory caddy that can be secured to an article of a golfer's clothing.

It is a further object of the invention to provide a golf accessory caddy that provides ready access to the accessories when needed.

It is a still further object of the invention to provide a golf accessory caddy that provides a holding and carrying mechanism for a ball marker, golf gloves, and at least one golf tee.

It is a still further object of the invention to provide a golf accessory caddy that accomplishes all or some of the above objects in combination.

Accordingly, a golf accessory caddy is provided. The golf accessory caddy comprising a body member having a ball marker storage cavity formed therein having an access opening defined by a first surface, the ball marker storage cavity having a substantially uniform cavity cross-sectional area along the length thereof; a ball marker retaining magnet positioned within the ball marker storage cavity, the ball marker retaining magnet having a magnet cross-sectional area smaller than the cavity cross-sectional area; a clip member extending from the body member, the clip member defining an insertion slot between the clip member and the body member; and a glove attachment surface covering at least a portion of the first surface having a plurality of securing members attachable to one of the hook and pile fastener surfaces of an existing golf glove. If desired, one or more tee holding cavities can be formed into the body member for receiving the tip end of a golf tee therein. The diameter and depth of each tee holding cavity are selected to allow frictional contact between the interior wall of the cavity and the tip end of a golf tee so that the tip end of the golf tee is frictionally held within the tee holding cavity when it is inserted therein. In a preferred embodiment the ball marker storage cavity is substantially cylindrical shaped and the ball marker retaining magnet is flat, and has a semi-circular shaped cross-section.

In another preferred embodiment, a ball marker is provided that is sized to fit within the ball marker storage cavity and includes a sufficient quantity of magnetically attractable material to allow the ball marker to be held within the ball marker storage cavity by contact with the ball marker retaining magnet. The ball marker is preferably disk shaped and sized such that at least a portion of the ball marker extends past the ball marker retaining magnet when the ball marker completely covers the ball marker retaining magnet. Having the ball marker extend past the retaining magnet allows the ball marker to be retrieved by pressing down on the portion that extends past the ball marker retaining magnet to cause the edge of the ball marker to pivot out of the ball marker retaining cavity where it can be easily grasped. The golf marker preferably further includes a surface thereof suitable for marking with desired identifying indicia, such as the name of a golf equipment manufacturer, golf tournament, or golf club. The body member is preferably molded from plastic and, if desired, the clip member can be integrally formed therewith.

BRIEF DESCRIPTION OF THE INVENTION

For a further understanding of the nature and objects of the present invention, reference should be had to the following detailed description, taken in conjunction with the accompanying drawings, in which like elements are given the same or analogous reference numbers and wherein.

DESCRIPTION OF THE EXEMPLARY EMBODIMENT

Figure 1:
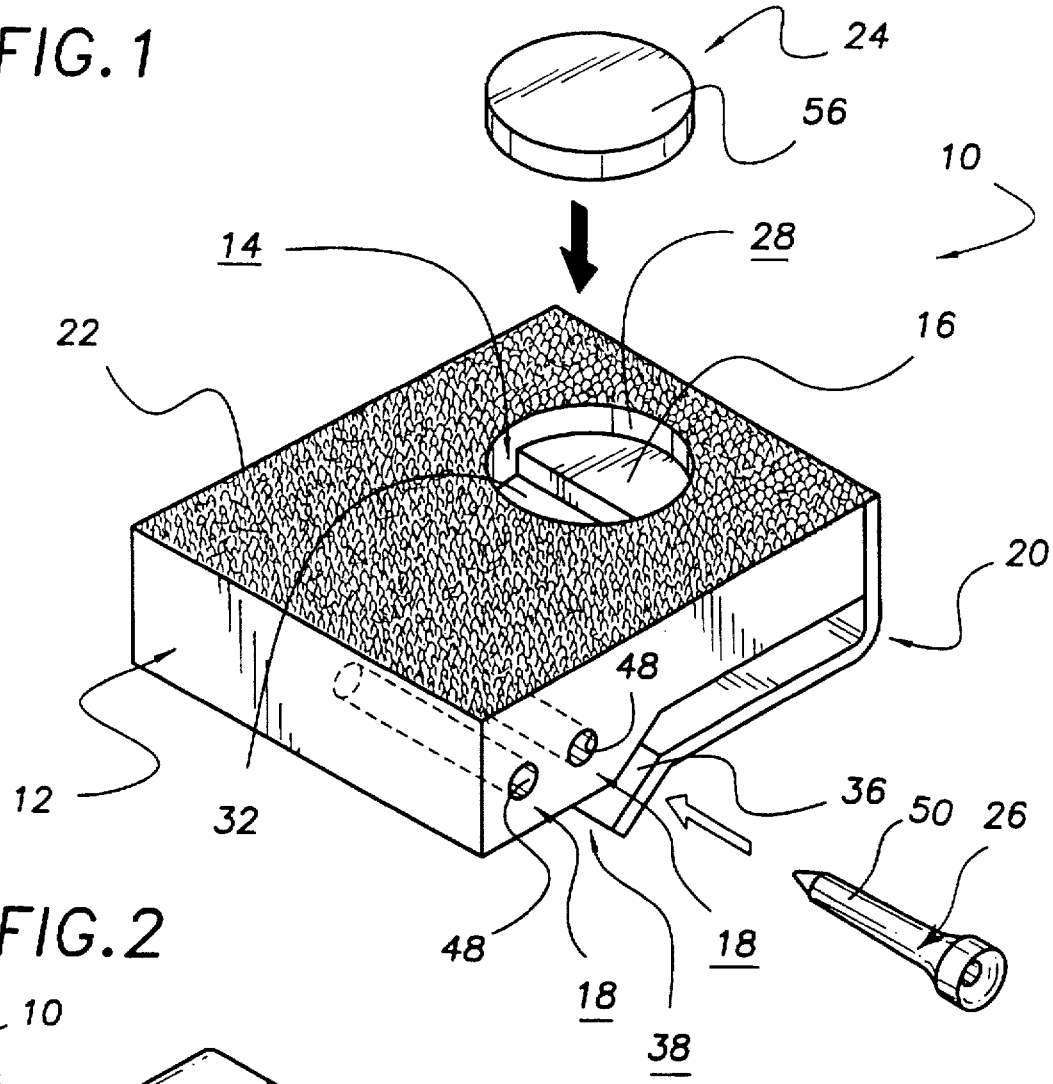
FIG. 1 is a perspective view of an exemplary embodiment of the golf accessory caddy of the present invention showing the body member, the ball marker storage cavity, the ball marker retaining magnet positioned within the ball marker storage cavity, a pair of tee holding cavities, the clip member, and the glove attachment surface. A representative ball marker and tee are also shown.

FIG. 1 shows an exemplary embodiment of the golf accessory caddy of the present invention, generally designated by the numeral 10. Caddy 10 includes a body member, generally designated 12; a ball marker storage cavity, generally designated 14; a ball marker retaining magnet 16; two tee holding cavities 18; a clip member, generally designated 20; and a glove attachment surface 22. Caddy 10 also includes a ball marker, generally designated 24, and a tee, generally designated 26.

Body member 12 is molded from plastic and has cylindrical ball marker storage cavity 14 formed therein. A circular access opening 30 into ball marker storage cavity 24 is formed through a substantially planar first surface of body member 12. Ball marker storage cavity 24 has a substantially uniform, circular, cavity cross-sectional area along the length thereof.

Ball marker retaining magnet 16 is a conventional ferrous magnet having a uniform partial circular cross-sectional area and a uniform thickness of about three-eights of one inch. Ball marker retaining magnet 16 is adhesively secured to a substantially planar bottom surface 32 that defines the bottom of ball marker storage cavity 24. Ball marker retaining magnet 16 has a cross sectional area equal to about two-thirds that of substantially planar bottom surface 32.

In this embodiment clip member 20 is constructed from metal and is adhesively secured to body member 12. Clip member 20 could of course be constructed of plastic and integrally formed with body member 12 if desired. A first surface 36 of clip member 20 defines an insertion slot 38 (more clearly shown in FIG. 3) between clip member 20 and body member 12. In use, the belt or waistband of the golfer is inserted through insertion slot 38 to secure caddy 10 in a convenient location.

Figure 2:
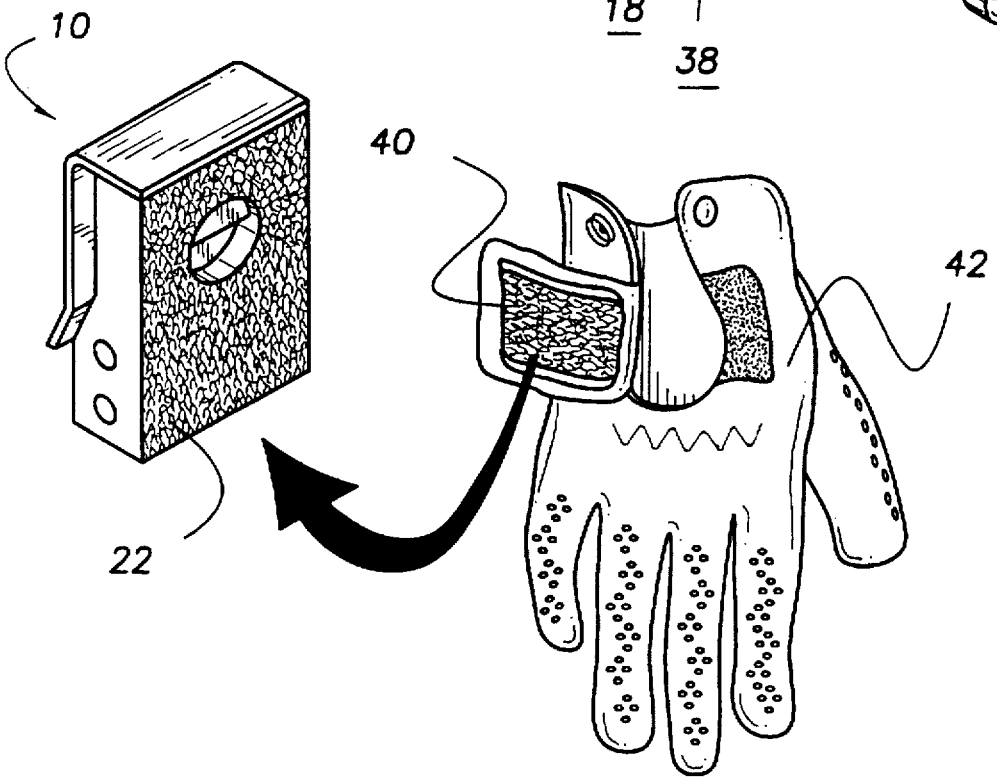
FIG. 2 is perspective view of the golf accessory caddy of FIG. 1 showing the manner of attaching a representative golf glove to the glove attachment surface.

In this embodiment glove attachment surface 22 is a section of hook material from a hook and pile fastener. Of course a section of pile material from a hook and pile fastener can be used if desired. With reference to FIG. 2, in use the pile section 40 of the hook and pile fastener of a golf glove 42 is attachable to glove attachment surface 22 by simply pushing pile section 40 against glove attachment surface 22.

Figure 3:
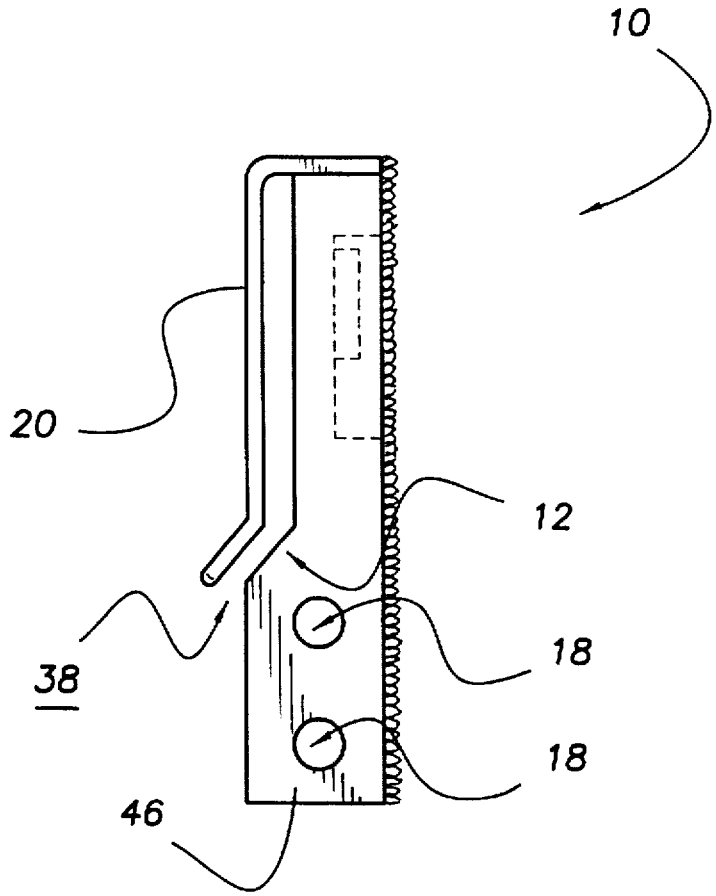
FIG. 3 is a side plan view of the golf caddy showing the tee holding cavities and the lateral insertion slot between the clip member and the back surface of the body member.

With reference to FIG. 3, tee holding cavities 18 are cylindrical shaped blind bores formed into a side surface 46 of body member 12. Referring back to FIG. 1, the diameter and depth of each tee holding cavity 18 are selected to allow frictional holding contact between an interior wall 48 of each tee holding cavity 18 and a tip end 50 of golf tee 26 when tip end 50 is inserted therein.

Ball marker 24 is a substantially circular, disk shaped section of magnetically attractable steel that is sized to fit within ball marker storage cavity 14. A top surface 56 is provided that is suitable for marking, such as by engraving or screen printing, with any desired identifying indicia, such as the name of a golf equipment manufacturer, golf tournament, or golf club. Top surface 56 can also have a raised emblem thereon if desired.

Figure 4:
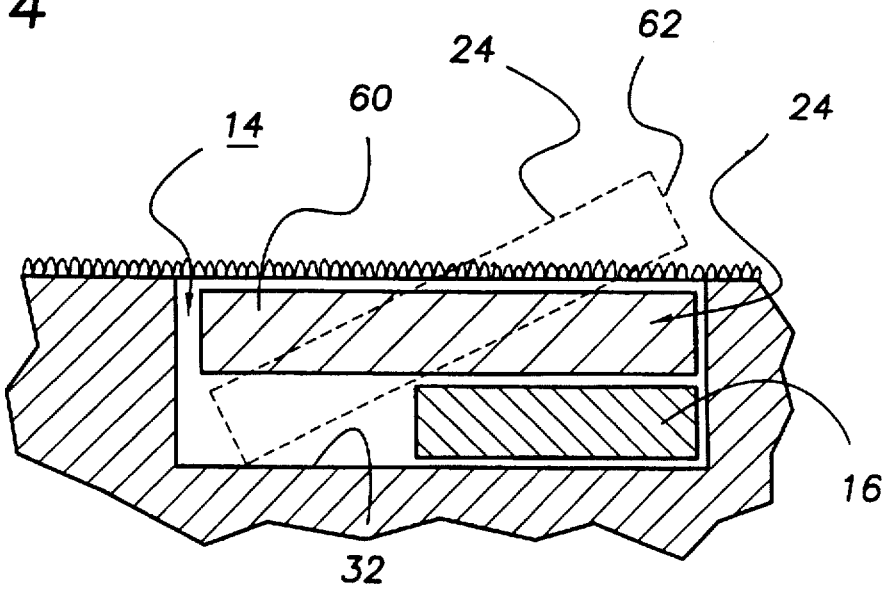
FIG. 4 is a sectional view across the ball marker storage cavity showing a representative ball marker in the storage position and in the retrieval position.

FIG. 4 shows ball marker 24 positioned within ball marker storage cavity 14 in contact with ball marker retaining magnet 16. In the storage configuration, a portion 60 of ball marker 24 overhangs ball marker retaining magnet 16 in a cantilever fashion above bottom surface 32 of ball marker storage cavity 14. When it is desired to retrieve ball marker 24 for use, portion 60 of ball marker 24 is pressed downward toward bottom surface 32 causing an edge 62 of ball marker 24 to pivot out of ball marker retaining cavity 14 where it can be easily grasped.

It can be seen from the preceding description that a golf accessory caddy has been provided that is securable to an article of a golfer's clothing; that provides ready access to the accessories when needed; and that provides a holding and carrying mechanism for a ball marker, golf gloves, and at least one golf tee.

It is noted that the embodiment of the golf accessory caddy described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

claims

What is claimed is:

1. A golf accessory caddy comprising:

a molded plastic body member having a ball marker storage cavity formed therein having an access opening defined by a planar first surface, said ball marker storage cavity having a substantially uniform cavity cross-sectional area along a length thereof, said ball marker storage cavity being substantially cylindrical shaped, said body member further including at least one tee holding cavity formed therein having a diameter and depth sufficient to receive the tip end of a golf tee therein in frictional gripping contact;

a ball marker retaining magnet positioned within said ball marker storage cavity, said ball marker retaining magnet having a magnet cross-sectional area smaller than said cavity cross-sectional area, said ball marker retaining magnet being flat, and having a semi-circular shaped cross-section;

a ball marker that is sized to fit within said ball marker storage cavity, said ball marker including a sufficient quantity of magnetically attractable material to allow said ball marker to be held within said ball marker storage cavity by contact with said ball marker retaining magnet;

a metal clip member adhesively secured to and extending from said body member, said clip member defining an insertion slot between said clip member and said body member; and a glove attachment surface covering at least a portion of said first surface having a plurality of securing members attachable to one of a hook and pile fastener surfaces of an existing golf glove;

said ball marker being sized such that at least a portion of said ball marker extends past said ball marker retaining magnet when said ball marker completely covers said ball marker retaining magnet, said golf marker including a surface suitable for marking with desired identifying indicia.

* * * * *